US006094871A

United States Patent [19]

Arnold et al.

[11] Patent Number: 6,094,871

[45] Date of Patent: Aug. 1, 2000

[54] HEADSTONE DISPLAY ASSEMBLY

[75] Inventors: Frank J. Arnold; William S. Choate, Jr., both of Fresno, Calif.

[73] Assignee: Arnold Systems Corporation, Inc., Fresno, Calif.

[21] Appl. No.: 09/192,799

[22] Filed: Nov. 16, 1998

Related U.S. Application Data

[60] Provisional application No. 60/066,928, Nov. 17, 1997.

[51] Int. Cl.[7] ..... E04H 13/00

[52] U.S. Cl. ..... 52/103; 40/124.5; 52/104

[58] Field of Search ..... 52/103, 104; 40/124.5

[56] References Cited

U.S. PATENT DOCUMENTS

| | | | |
|---|---|---|---|
| 4,227,325 | 10/1980 | Whitford . | |
| 4,285,149 | 8/1981 | Berryhill | 40/124.5 |
| 4,304,076 | 12/1981 | Splendora | 52/104 |
| 4,463,527 | 8/1984 | Schlosser | 52/103 |
| 4,790,088 | 12/1988 | Morvant | 40/124.5 |
| 5,553,426 | 9/1996 | Ostergaard | 52/103 |
| 5,687,515 | 11/1997 | Rodriques . | |
| 5,729,921 | 3/1998 | Rojas . | |
| 5,732,515 | 3/1998 | Rodrigues . | |
| 5,787,625 | 8/1998 | Yesbick | 40/718 |
| 5,822,895 | 10/1998 | Risdal | 40/124.5 |

*Primary Examiner*—Beth A. Stephan
*Attorney, Agent, or Firm*—Richard A. Ryan

[57] ABSTRACT

A headstone display assembly for flush placement inside an inlet cut out of the surface of a horizontally or vertically disposed headstone. The display assembly is also suitable for use when the display is to be mounted directly on the surface of the headstone. The display assembly has a back panel hingedly connected to a lid panel with a hinge member formed out of the integral ends of the lid panel and the back panel. The lid panel and back panel form a cavity for storing memorabilia suitable for being displayed with a headstone. A tab stop can be utilized in the hinge assembly to prevent full opening of the lid panel to prevent the lid panel from being left open and exposing the memorabilia to the elements. The display assembly is relatively simple to manufacture and install and provides a aesthetically pleasing display suitable for displaying all types of memorabilia.

19 Claims, 5 Drawing Sheets

HEADSTONE DISPLAY ASSEMBLY

CROSS-REFERENCE TO RELATED APPLICATIONS

This application claims the benefit of U.S. Provisional Application No. 60/066,928, filed Nov. 17, 1997.

BACKGROUND OF THE INVENTION

A. Field of the Invention

The field of the present invention relates generally to retainer assemblies and display insert assemblies for headstones and cemetery display units. More specifically, this invention relates to assemblies for displaying portraits, photographs, illustrations or the like, as well as any combination thereof, on headstones or other cemetery display units.

B. Background

The use of picture frames, lockets, display cases and the like on headstones and other cemetery display units to display and protect memorabilia has been known for many years. While these various items can generally display and protect those items felt worthy of such display and preservation, there are shortcomings of each with regard to use on headstones and other cemetery display units. In particular, what has been lacking is a display assembly that enables displayed items to be inset into a space with a minimum amount of clearance and a final surface fit that is flush with the surface of the surrounding material. Such an assembly would be particularly advantageous when inletting materials which do not lend themselves to direct tooling. An example of such material is stone, which is commonly used for headstones and other cemetery display units.

In many cemeteries, both human and animal, it has become mandatory for headstones to be set in a horizontal position flush with the ground level so that the headstones will not interfere with maintenance equipment, such as lawn mowers. These cemeteries generally have regulations that prohibit or limit vertical projections above the horizontal face of the inscribed stone. Problems exist because the existing portrait display options were primarily designed to be mounted on headstones that project vertically from the ground surface. When used in cemeteries where only flush mounting is allowed, these displays must be inset into oversized cavities cut out of the headstone.

The procedures commonly used to cut the stone results in inlets having curved walls. Although tools are available to cut vertical wall inlets in stone, these tools are expensive and not available to all who wish to achieve a suitable inlet in stone for a display assembly. The most common procedure to inlet stone is to sandblast or impact cut the desired area with powdered media of varying grades. This renders a cavity in the stone with coved or concave sides. In the past, this cavity has been carved much larger than the item to be inset to compensate for the reduction in bondable surface caused by the coving. Unfortunately, the excess space around the display assembly creates an area for trapping dirt, water or other foreign material, such as the deposit of minerals and alkalies from irrigation systems. Aside from the obvious maintenance problem, the resulting inset is thought by many to be an unattractive distraction (i.e., the large gaping border detracting from the inlaid item it was meant to hold). There exists a need for an assembly that provides a suitable display environment without the excess space problem in the memorial and monument industry.

SUMMARY OF THE INVENTION

The headstone display assembly of the present invention solves the problems identified above. Specifically, the present invention discloses an assembly for displaying portraits, photographs, illustrations or the like, as well as any combination thereof, either in an inlet area of a headstone or directly on the surface of the headstone. The flush display embodiment of the present invention allows use of an inlet display without the necessity of creating a much larger inletting area than is needed. The present invention overcomes the visual hindrance of oversized inletting while presenting a durable means of retaining that which is displayed. The present invention also includes a lid panel and a hinge mechanism that closes flush to the inletted surface of the headstone to protect the material being displayed. In an alternative embodiment of the present invention, where inletting of the headstone is not possible or desired, the display assembly of the present invention can be attached to the outer surface of the headstone for display purposes.

The flush version of the preferred embodiment of the present invention is particularly suited for use in modern cemetery applications. It fits flush to surface, may be made from all-weather durable materials, presents a respectful impression and may be decorated to match any motif. The same principles apply to wall mounted memorials, dedications, etc., whereby the invention may be placed flush to the vertical surface. The present invention overcomes both aesthetic and application shortcomings of existing inferior methods of memorialization.

The headstone display assembly of the present invention utilizes a back panel that is smaller than the lid panel with the display area being located against the back panel. With this configuration, it is possible to create an inlaid display that compensates for the smaller area of the bonding surface, relative to the opening at the surface of the headstone, in the inletted cavity. In the preferred embodiment, the display assembly utilizes an integral hinge mechanism that is created during the manufacturing of the lid and back panels, thus eliminating the need for additional hinges, pins, clips, etc. to achieve a workable opening movement. The hinge mechanism of the preferred embodiment remains below the level of the surface of the headstone upon closure of the lid panel and allows the shallowest and smallest possible inlet, thereby reducing the open area surrounding the closed display assembly to a minimum.

The present headstone display assembly is a able to accommodate many variety of displays made by those in the industry. The display is bonded to the back panel, beneath the lid panel, in the inlay assembly. If the assembly is to be mechanically attached to a surface and or inletted material, the back panel of the display assembly may be drilled and attached prior to attachment of the display insert. If the back panel and lid panel are made of metal, mounting hardware for mechanical attachment devices may be welded or drilled through. In other materials, it is possible to precast, extrude or bond one or more pegs, studs, all-thread or expanding anchor pin assemblies to the back of the retainer assembly.

The finished assembly is placed in a prepared inlet or directly on the surface of the headstone with an appropriate adhesive or fastener. Prior to hardening of the adhesive or tightening of the fastener, the assembly may be adjusted by hand until it is level and flush, for the flush embodiment, or in the proper position, for the surface embodiment, as desired.

Accordingly, the primary objective of the present invention is to provide a headstone display assembly that is an attractive and respectful assembly for displaying text, portraits, photographs, illustrations or the like inset into or on a headstone.

It is also an important objective of the present invention to provide a headstone display assembly that is relatively easy and inexpensive to manufacture and install.

It is also an important objective of the present invention to provide a headstone display assembly that has an opening lid panel hingedly attached to a back panel that is suitable for use in an inlet cut into a headstone so that the lid panel and hinge mechanism are flush with the surface of the headstone while requiring a minimum amount of space between the display assembly and the inlet.

It is also an important objective of the present invention to provide a headstone display assembly that has a opening lid panel hingedly attached to a back panel that is suitable for attachment to the surface of a headstone.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the best modes presently contemplated for carrying out the present invention.

DETAILED DESCRIPTION

Figure 1:
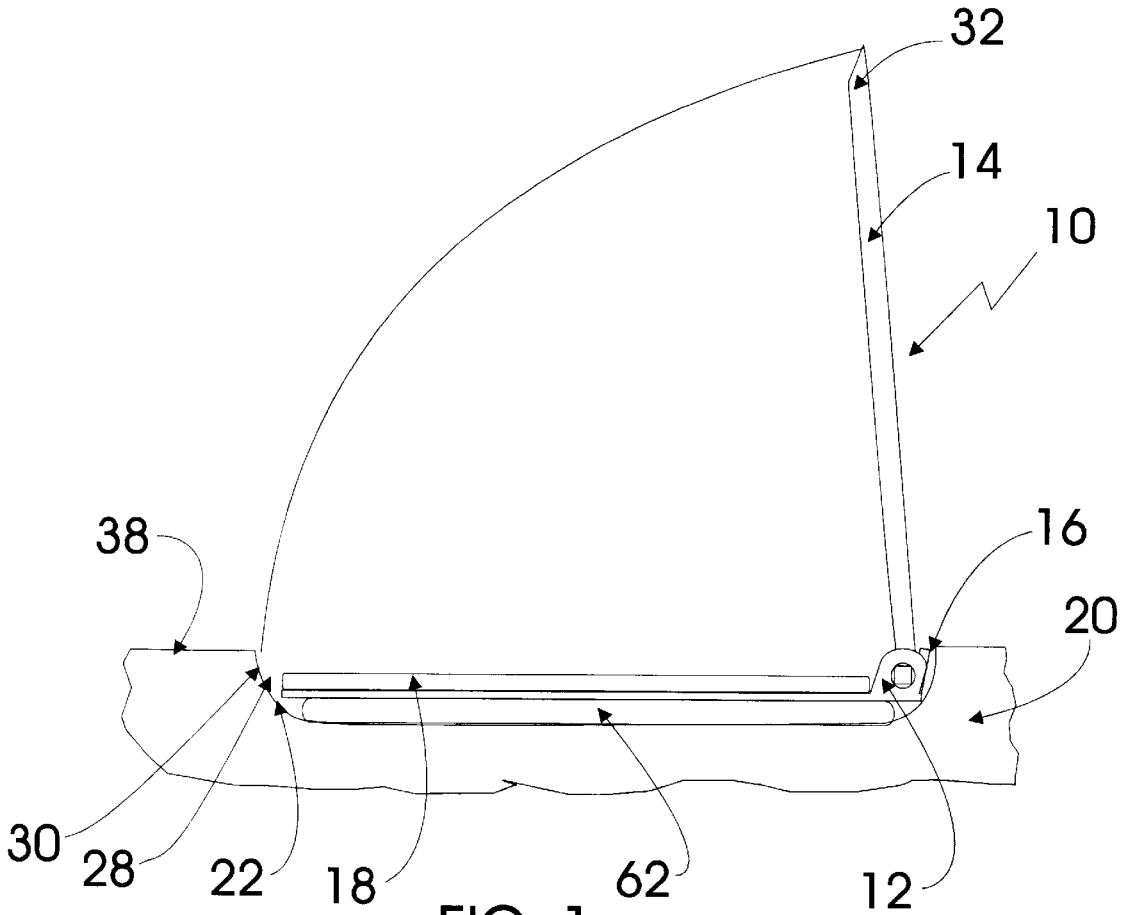
FIG. 1 is a side view of the flush configuration of the display assembly of the present invention in an open position.
Figure 2:
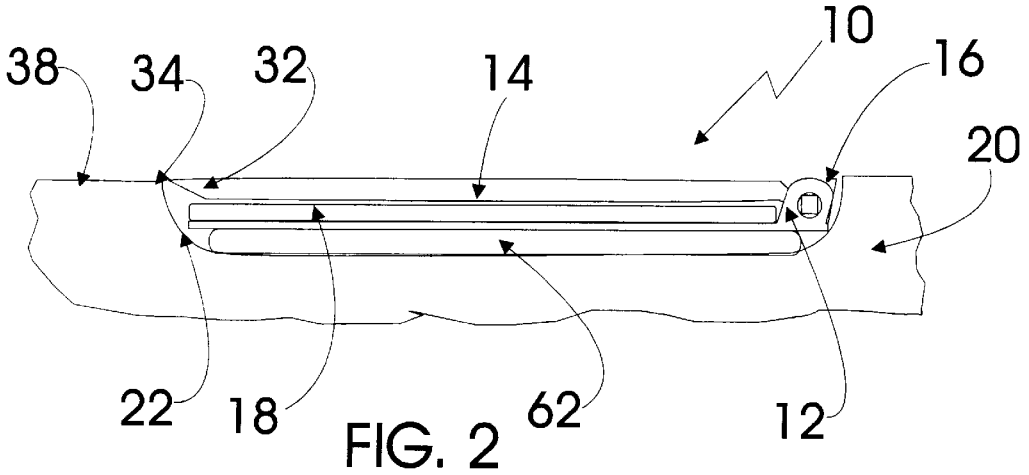
FIG. 2 is a side view of the flush configuration of the display assembly of the present invention in a closed position.

With reference to FIGS. 1 through 10, where like elements have been given like numerical designations to facilitate understanding of the present invention, the headstone display assembly of the present invention is designated generally 10. As shown in FIGS. 1 and 2, the assembly 10 is primarily composed of back panel 12, lid panel 14 and hinge mechanism 16. These elements are connected together to create a space intended to retain a display 18, which can comprise text, illustrations, portraits, photographs or any combination thereof. Assembly 10 is designed for inlay into or attachment to a headstone 20 made out of any material, such as stone. As shown in FIGS. 1 and 2, assembly 10 can be placed in an inlet 22 that is made by sand blasting, tool work, casting, carving or the like, or any combination of these or other manufacturing processes that are commonly known in the industry.

Assembly 10 may be used on headstones or other cemetery display units, whether having horizontal or vertical surfaces. Hinge 16 may be positioned at any place around the outer perimeter of assembly 10, depending on the intended use of assembly 10. The outer dimensions of assembly 10 may be square, rectangular, oval, circular or any other desired shape of any size. To allow for the natural coving of some materials when inletted, such as stone, the dimensions of back panel 12 are smaller than those of lid panel 14. In this manner, as shown in FIG. 2, the outer edge 24 of lid panel 14 overlaps the outer edge 26 of back panel 12 creating a covered channel 28 between the display assembly 10 and the side 30 of inlet 22. Moisture can run off the display 18 and collect in and evaporate from channel 28, thereby reducing or eliminating the build-up of minerals or alkali deposits on display 18.

The forward edge 32 of lid panel 14, which is opposite hinge mechanism 16, is beveled to facilitate the lifting of lid panel 14 with the least amount of edge space 34 between inlet 22 and lid panel 14. For flush mount display assemblies, as shown in FIGS. 1 and 2, headstone 20 in which assembly 10 is to be placed is cut to a depth which will allow assembly 10 to rest, with adhesion or mechanical attachment, such that the outer surface 36 of lid panel 14 is flush with surface 38 of headstone 20. As the depth of inlet 22 may vary, assembly 10 is designed to function whether lid panel 14 is flush with, below or above surface 38.

Figure 6:
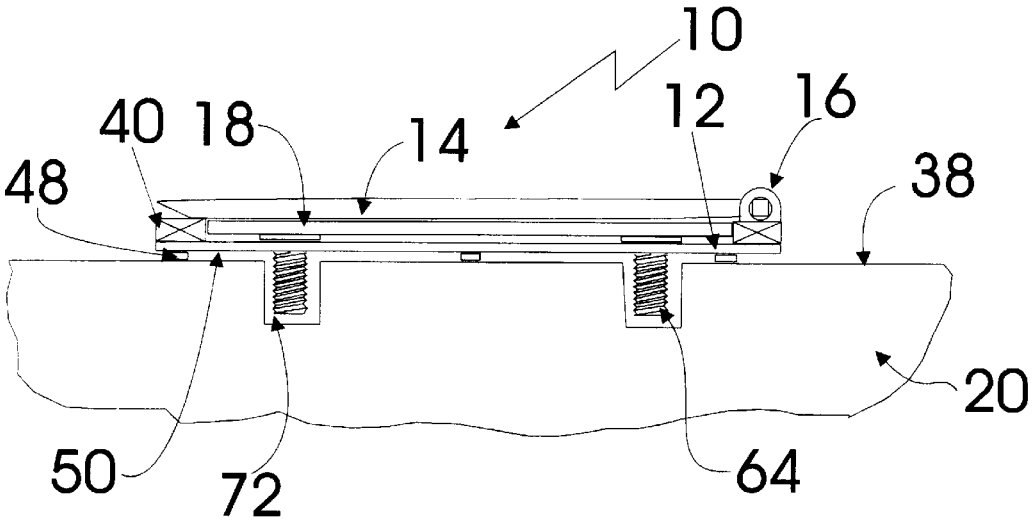
FIG. 6 is a side view of the present invention installed on the surface of a headstone with screws.
Figure 7:
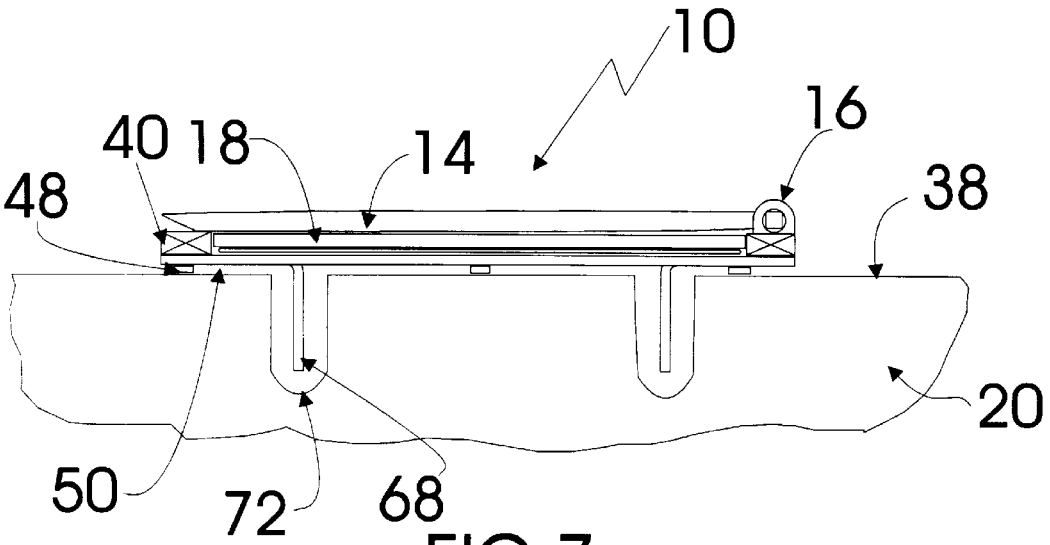
FIG. 7 is a side view of the present invention installed on the surface of a headstone with anchors.

For surface mounting of display assembly 10, as shown in FIGS. 6 and 7, wherein display assembly 10 is mounted on surface 38 of headstone 20, the display assembly 10 utilizes the same back panel 12, lid panel 14 and hinge mechanism 16 combination as for flush mounting of the assembly 10. However, back panel 12 can be smaller, larger or the same size as lid panel 14. The use of a back panel 12 which is larger than lid panel 14 provides a decorative reveal around the edge 24 of lid panel 14. As with the flush mounting, the forward edge 32 of lid panel 14 is beveled to facilitate lifting lid panel 14 to view display 18. A spacer ring 40 having a hinge notch 42, sized and configured to be compatible with hinge 16, and opening 44 is utilized for placement of display 18 in opening 44. Spacer ring 40 should create a non-watertight seam that provides the same evaporative advantage as used in the flush embodiment by drawing moisture away from display 18 to reduce or eliminate the collection of moisture within assembly 10. For the surface mount configuration, display assembly 10 also utilizes one or more spacers 48 (shown in FIGS. 6 through 9) to create a space 50 between back panel 12 and headstone 20. The purpose of spacers 48 is to prevent metal to stone contact that is known to cause discoloration of headstone 20 from weeping of mineral deposits. Spacers 48 should be made of stainless steel or other non-corrosive materials.

Figure 3:
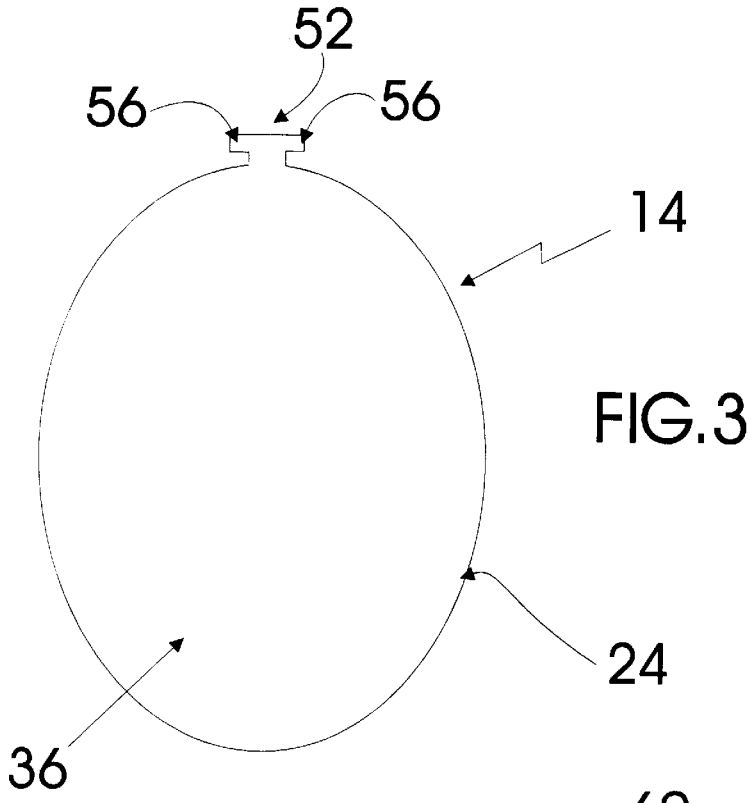
FIG. 3 is a plan view of the lid panel of the present invention.
Figure 4:
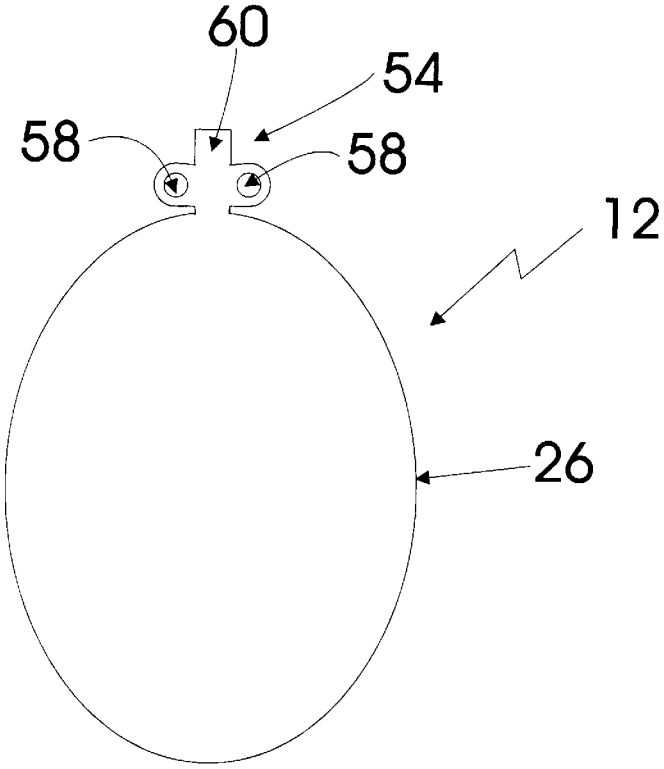
FIG. 4 is a plan view of the back panel of the present invention.

In the preferred embodiment, hinge 16 is an adjustable tab-stop hinge which limits the extent to which lid panel 14 may be opened (i.e., the angle relative to horizontal) and which is suitable for providing a flush profile and minimal edge space 34. There are applications for assembly 10 where placement will be in or on a horizontal surface located outdoors. By limiting the extent to which lid panel 14 may be raised, the chance of damage to lid panel 14 and display 18 is minimized. In the preferred embodiment, hinge 16 is set such that the maximum open angle, measured from the horizontal, is less than 90 degrees so that after a person views display 18, lid panel 14 will fall to a closed position to protect display 18 from sun or other damage between viewings. In the preferred embodiment, hinge 16 is comprised of components manufactured integral with back panel 12 and lid panel 14, as shown in FIGS. 3 and 4. To create hinge 16, first hinge member 52, integral with lid panel 14, is folded downward and second hinge member 54, integral with back panel 12, is folded upward. Ends 56 of first hinge member 52 are placed inside openings 58 in second hinge member 54 such that openings 58 pivot around ends 56 of first hinge member 52. Tab member 60, integral with second hinge member 54, is also folded up to prevent full opening of lid panel 14, as discussed above.

Assembly 10 may be manufactured from any rigid or semi-rigid materials, such as bronze or nickel-silver alloy, which are commonly used in the industry. It may be stamped, extruded, cast, injection molded, vacuum formed, mill cut, routed, saw cut and or computer numeric control manufactured. Lid panel 14 may be decorated by engraving, stamping, etching, carving, painting and or lamination of its top and/or bottom surfaces.

The assembly 10 of the present invention is able to protect and exhibit a display 18 made by a variety of methods for making such displays that are known in the industry. After display 18 is prepared, it is bonded to back panel 12 beneath lid panel 14 of display assembly 10. If assembly 10 is to be mechanically attached to surface 38 or inlet 22, back panel 12 may be drilled and attached prior to attachment of display 18. If back panel 12 and lid panel 14 are made of metal, mounting hardware for mechanical attachment may be welded or drilled therethrough. In other materials, it is possible to precast, extrude or bond one or more pegs, studs, all-thread or expanding anchor pin assemblies to back panel 12 of assembly 10.

Figure 5:
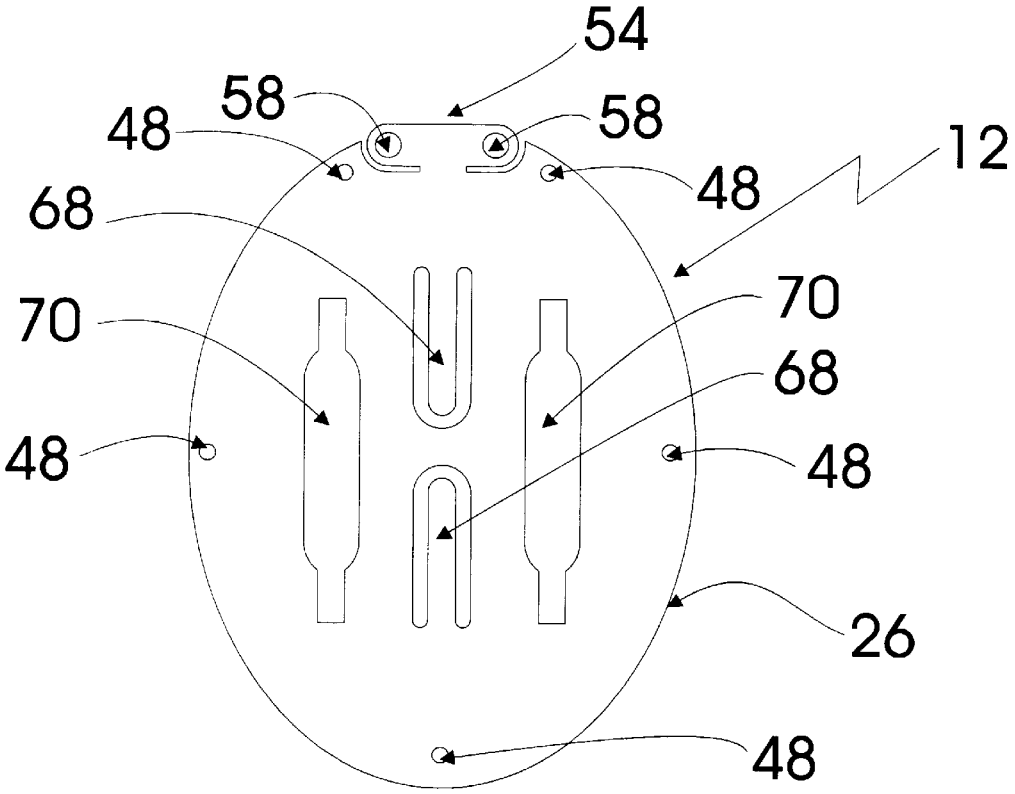
FIG. 5 is a plan view of the back panel of the present invention showing the keyhole opening for installation on the surface of a headstone.
Figure 8:
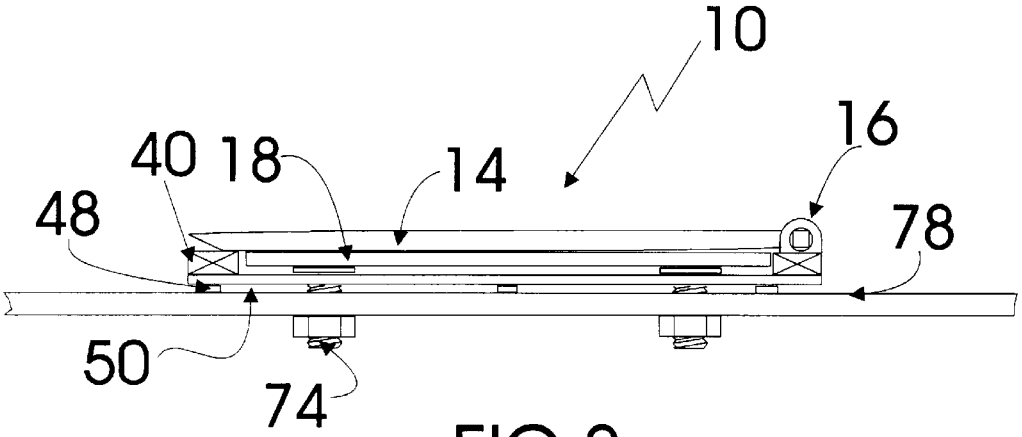
FIG. 8 is a side view of the present invention installed on a mounting member with bolts.
Figure 9:
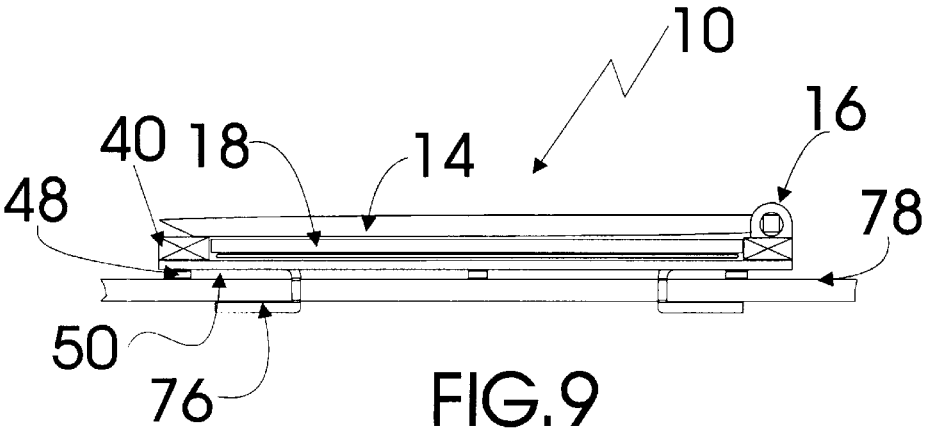
FIG. 9 is a side view of the present invention installed on a mounting member with anchor tabs.
Figure 10:
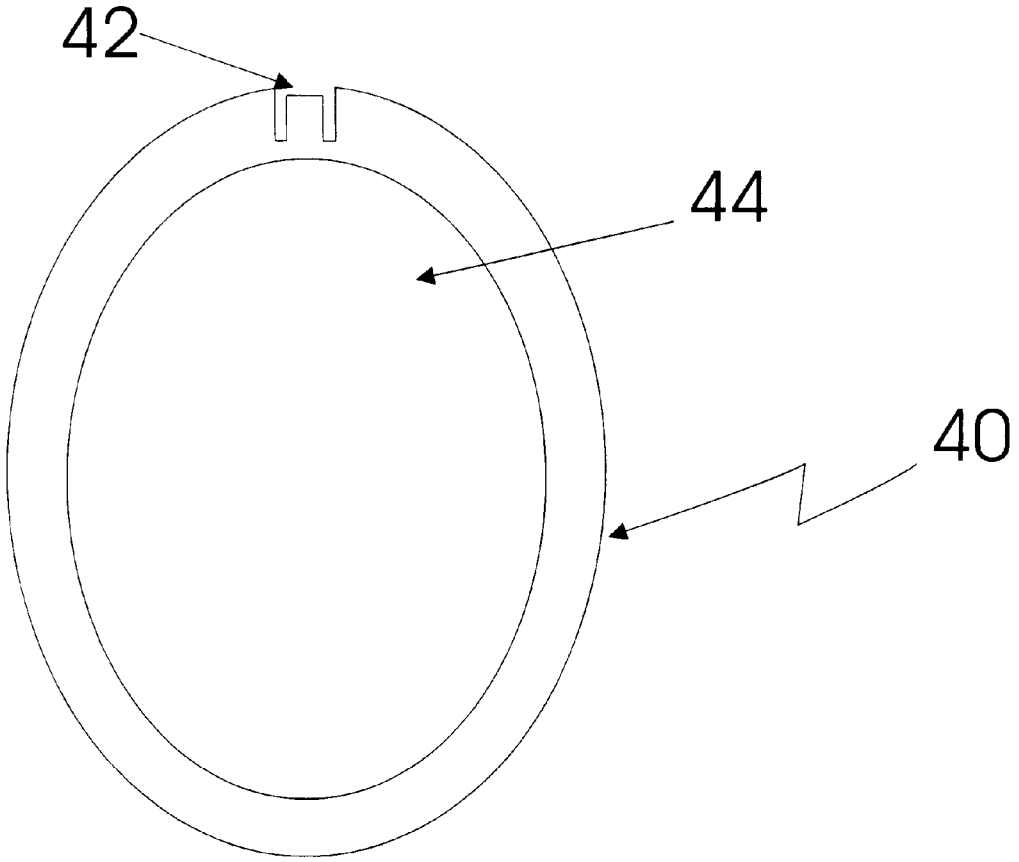
FIG. 10 is a plan view of the spacer ring for the surface installation embodiment of the present invention.

To place assembly 10 and display 18 in inlet 22 or on the surface 38 of headstone 20 without any drilling or use of mechanical attachments, adhesive 62 compatible with the materials to be bonded must be applied to inlet 22 or surface 38, as shown in FIGS. 1 and 2. Sufficient adhesive 62 must be used to secure display assembly 10, but not so much as to bleed around edges 26 and 24 of back panel 12 and lid panel 14, respectively. Once the final bonding is complete, lid panel 14 may be opened and closed as desired to view display 18. As shown in FIGS. 6 and 7, in the surface mount configuration the display assembly 10 is attached or mounted on surface 24 of headstone 20, or other flat surfaces, by the use of screws 64 (or studs) or anchors 68, as shown in FIGS. 6 and 7, respectively. As shown in FIG. 5, back panel 12 can have one or more keyhole openings 70 for insertion of mounting screws 64 or studs 66. Headstone openings 72 can be filled with an adhesive material that is suitable for bonding screws 64 or anchors 68 to fixedly attach display assembly 10 to headstone 20. Alternatively, bolts 74, as shown in FIG. 8, or fold down anchor tabs 76, as shown in FIG. 9, can pass through back panel 12 and attach back panel 12 to a mounting member 78, such as a bronze plaque.

The display assembly 10 of the present invention, as set forth above, can be included with new headstones 20 or added to an existing headstone 20 with reasonable modifications to the headstone 20. Display assembly 10 is a relatively simple assembly to manufacture and install and provides a more attractive means of displaying memorabilia on a headstone 20. The flush mount configuration allows use of a display assembly 10 on a ground level headstone 10 without interfering with cemetery lawn maintenance equipment.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A headstone display assembly for displaying memorabilia in an inlet cut into a headstone, comprising:

a lid panel having an outer surface, said lid panel sized and configured to minimize space between said lid panel and said inlet;

a back panel, said back panel being dimensionally smaller than said lid panel so that said lid panel overlaps said back panel;

hinge means for hingeably connecting said lid panel to said back panel, said lid panel and said back panel forming a cavity for holding the memorabilia in said display assembly, said lid panel able to pivot relative to said back panel to display the memorabilia; and attachment means for attaching said back panel to the headstone.

2. The headstone display assembly of claim 1, wherein said outer surface of said lid panel is substantially flush with said headstone.

3. The headstone display assembly of claim 1, wherein said lid panel and said back panel form a channel to distribute water off of said outer surface of said lid panel.

4. The headstone display assembly of claim 1, wherein said hinge means comprises a first hinge member integral with said lid panel and a second hinge member integral with said back panel.

5. The headstone display assembly of claim 4, wherein said first hinge member is pivotally connected to said second hinge member.

6. The headstone display assembly of claim 4, wherein said hinge means further comprises a tab member for preventing full opening of said lid panel.

7. The headstone display assembly of claim 1, wherein said hinge means further comprises a tab member for preventing full opening of said lid panel.

8. The headstone display assembly of claim 1, wherein said attachment means is an adhesive.

9. The headstone display assembly of claim 1, where said attachment means comprises a keyhole opening in said back panel for connecting said back panel to the headstone.

10. The headstone display assembly of claim 1, wherein said attachment means connects said back panel to a mounting member, said mounting member attached to the headstone.

11. The headstone display assembly of claim 1 further comprising one or more spacers disposed between said back panel and said headstone.

12. A headstone display assembly for displaying memorabilia in an inlet cut into a headstone, comprising:

a lid panel having an outer surface and an outer edge;

a back panel having an outer edge, said outer edge of said lid panel overlapping said outer edge of said back panel;

hinge means for hingeably connecting said lid panel to said back panel, said lid panel and said back panel forming a cavity for holding the memorabilia in said display assembly, said lid panel able to pivot relative to said back panel to display the memorabilia; and attachment means for attaching said back panel to the headstone.

13. The headstone display assembly of claim 12, wherein said outer surface of said lid panel is substantially flush with said headstone.

14. A headstone display assembly for displaying memorabilia in conjunction with a headstone, comprising:

a lid panel having an outer surface;

a back panel;

hinge means for hingeably connecting said lid panel to said back panel, said hinge means having a tab member for preventing full opening of said lid panel, said lid panel and said back panel forming a cavity for holding the memorabilia in said display assembly, said lid panel able to pivot relative to said back panel to display the memorabilia; and attachment means for attaching said back panel to the headstone.

15. The headstone display assembly of claim 14 further comprising one or more spacers disposed between said back panel and said headstone.

16. The headstone display assembly of claim 14, wherein said hinge means comprises a first hinge member integral with said lid panel and a second hinge member integral with said back panel.

17. The headstone display assembly of claim 14, wherein said assembly is configured to fit within an inlet cut into the headstone, said back panel being dimensionally smaller than said lid panel so that said lid panel overlaps said back panel, wherein said lid panel is sized and configured to minimize space between said lid panel and said inlet.

18. The headstone display assembly of claim 17, wherein said outer surface of said lid panel is substantially flush with said headstone.

19. The headstone display assembly of claim 17, wherein said lid panel and said back panel form a channel to distribute water off of said outer surface of said lid panel.

* * * * *